United States Patent [19]

Kubo et al.

[11] Patent Number: 4,812,110

[45] Date of Patent: Mar. 14, 1989

[54] OIL-FREE SCREW COMPRESSOR WITH BYPASS OF COOLED DISCHARGED GAS

[75] Inventors: Kazuo Kubo, Kobe; Noboru Tsuboi, Kakogawa; Kunihiko Nishitani, Akashi; Ituro Nomura, Takarazuka, all of Japan

[73] Assignee: Kabushiki Kaisha Kobe Seiko Sho, Kobe, Japan

[21] Appl. No.: 79,397

[22] Filed: Jul. 30, 1987

[30] Foreign Application Priority Data

Aug. 11, 1986 [JP] Japan ..... 61-188864
Dec. 19, 1986 [JP] Japan ..... 61-304957

[51] Int. Cl.[4] ..... F04C 18/16; F04C 29/04

[52] U.S. Cl. ..... 418/1; 418/15; 418/83; 418/201

[58] Field of Search ..... 418/83, 85, 86, 1, 15, 418/201

[56] References Cited

U.S. PATENT DOCUMENTS 3,575,539 4/1971 Hanick ..... 418/99
4,106,304 8/1978 Eskeli ..... 418/86
4,174,196 11/1979 Mori ..... 418/86

FOREIGN PATENT DOCUMENTS 2123737 11/1972 Fed. Rep. of Germany ..... 418/86
60-166785 8/1985 Japan .
61-101693 5/1986 Japan .

*Primary Examiner*—John J. Vrablik
*Attorney, Agent, or Firm*—Oblon, Fisher, Spivak, McClelland & Maier

[57] ABSTRACT

Described herein is a method for operating an oil-free screw compressor and an oil-free screw compressor construction, the method including the step of feeding a gas of a temperature Ta to a discharge space in the vicinity of the discharge port of the compressor, the temperature Ta satisfying the relationship $$Ta \leqq Tl/k$$

wherein Ta is the temperature (°K.) of said feed gas; Tl is the temperature (°K.) of the compressed gas before feeding; and k is a polytropic index number.

1 Claim, 4 Drawing Sheets

OIL-FREE SCREW COMPRESSOR WITH BYPASS OF COOLED DISCHARGED GAS

BACKGROUND OF THE INVENTION

1. Field of the Invention

This invention relates to a method for operating oil-free screw compressors and to an improvement in oil-free screw compressor construction.

2. Description of the Prior Art

Heretofore, the discharge pressure of a single-stage oil-free screw compressor has been limited, for example, to approximately 2–4 kg/cm$^2$G maximum due to a temperature rise which occurs at the time of compression. At the present time, some commercialized products have a discharge pressure of about 7.0 kg/cm$^2$G thanks to improvements in rotor tooth profile and machining accuracy. In the situation where the discharge pressure is raised to 7.0 kg/cm$^2$G, the discharge gas temperature reaches a level of 330°–340° C.

Although the current market has a trend towards demanding compressors with a higher discharge pressure of almost 10 kg/cm$^2$G, the discharge gas temperature would rise to 380°–400° C. if the internal pressure ratio were increased to raise the discharge pressure to, for example, 8.5–8.8 kg/cm$^2$G. Therefore, it is extremely difficult to prevent rotor contacts due to thermal expansion simply by improving the rotor tooth profile, coupled with difficulty in controlling the gap space of rotor tooth profile during operation.

In order to solve this problem, it is necessary to water- or oil-cool the compressor casing by providing a cooling apparatus, which is, however, reflected by increases in cost and installation floor space.

Thus, under these circumstances, the marked rise in the discharge gas temperature has barred commercialization of air-cooled compressors employing air-cooled casings or water-cooled casings combined with an air-cooling radiator for cooling water to the casings.

On the other hand, especially in an attempt to realize the above-mentioned high discharge pressure, Japanese laid-open patent application No. 60-166785 proposes an oil-free compressor which is designed to raise the discharge pressure without elevating the discharge temperature. For this purpose, part of the discharge gas is returned to the suction side of the compressor, raising the discharge pressure by substantially increasing the suction pressure without varying the internal pressure ratio. More particularly, such discloses that the compressor returns the discharge gas to a position in a gas enclosed zone of the rotor chamber which is partitioned from the suction port and at a position close to the suction port or immediately after suctioning, suppressing increases in the discharge temperature by returning well-cooled gas.

However, although the compressor of the abovementioned patent application, in which part of the discharge gas is returned to the suction side after cooling, is capable of raising the discharge pressure while suppressing the temperature to a low level, such is characterized by the problem that the compressor requires greater power for recompressing part of the discharge gas which is returned to the suction side.

SUMMARY OF THE INVENTION

In view of the foregoing, the present invention has as its object the provision of a method for operating an oil-free screw compressor and an improved oil-free screw compressor construction, which can solve the abovementioned problems.

According to one aspect of the invention, the abovementioned problems are solved by feeding a gas of a temperature $Ta \leqq T1/k$ to a discharge space in the vicinity of the discharge port of an oil-free screw compressor, wherein Ta is the temperature (°K.) of the feed gas, T1 is the temperature (°K.) of the compressed gas before feeding, and k is the polytropic index number.

The above and other objects, features and advantages of the invention will become apparent from the following description and the appended claims, taken in conjunction with the accompanying drawings which show by way of example some preferred embodiments of the invention.

DESCRIPTION OF THE PREFERRED EMBODIMENTS

Figure 1:
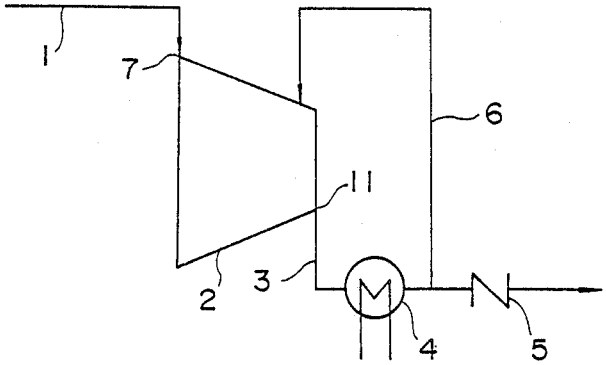
FIG. 1 is a block diagram of an oil-free screw compressor to which the operating method of the present invention is applied.

Hereafter, the invention is illustrated more particularly by way of preferred embodiments shown in the drawings.

Referring to FIG. 1, there is shown an oil-free screw compressor incorporating the method of the invention, wherein a gas flow passage is formed from a suction passage 1 to a discharge passage 3 through a main compressor casing 2. The discharge passage 3 is provided with an after-cooler 4 and a check valve 5. Further, a gas returning bypass passage 6 is extended from a point intermediate the after-cooler 4 and check valve 5 of the discharge passage 3 to a predetermined position of the rotor chamber (not shown) within the compressor casing 2, for returning part of the cooled gas from the after-cooler 4 to a space in a compression stage within the rotor chamber. More specifically, the afore-mentioned predetermined position of the rotor chamber is restricted to a location which satisfies the condition of $$Ta \leqq (T1/k) \quad (1)$$

where Ta is the temperature (°K.) of the feed gas, namely, of the gas which is returned to the rotor chamber through the bypass passage 6 in this particular embodiment; T1 is the temperature (°K.) of the compression gas before feeding; and k is the polytropic index number. Normally, the return position is not located in the vicinity of the suction port, and is preferred to be in the vicinity of the discharge port (not shown) for enhancing the heat insulation efficiency.

As shown by thermodynamic formulas presented hereinbelow an arrangement is made to raise the discharge pressure without entailing increases in the discharge gas temperature.

As seen from the above-described construction of the apparatus, this embodiment of the operating method according to the present invention is intended for application to an oil-free screw compressor to feed part of the cooled discharge gas from the after-cooler 4 to a space in the rotor chamber in a manner which satisfies the condition of Equation (1).

Following are explanations on the steps which lead to Equation (1).

In adiabatic compression of a gas, the temperature P1 and the temperature T1 of the compressed gas are in the following relationship which is known as a general formula in thermodynamics.

$$T_1 = Ts\left(\frac{P_1}{Ps}\right)^{\frac{k-1}{k}} \quad (2)$$

wherein Ts is the temperature before compression, namely, the temperature (°K.) of the suction gas in this particular embodiment; and Ps is the pressure before compression, namely, the pressure of the suction gas in this embodiment.

On the other hand, when a gas (of temperature T1 and pressure P1) of a given volume is mixed with a gas (of temperature Ta), which has a pressure high enough for feeding the same into the pressure of the first gas, without changing the volume, the temperature T and pressure P of the mixed gases have the following relationship.

$$T = k \cdot Ta \cdot \frac{1}{1 + \left(\frac{kTa}{T_1} - 1\right)\frac{P_1}{P}} \quad (3)$$

Therefore, $$T_1 - T = \frac{T_1}{kTa \cdot \frac{P_1}{T_1} + \left(1 \frac{P_1}{P}\right) \cdot T_1} \times (T_1 - kTa)\left(1 - \frac{P_1}{P}\right) \quad (4)$$

Since (1−P1/P) is invariably positive, the first and third terms on the right side of Equation (4) are positive, and when T1>kTa, the right side of Equation (4) is >0.

This means that, when Ti>kTa, Ti>T irrespective of the gas pressure, and that the temperature is not increased by the feed gas even though the pressure is increased.

Now, considering a more particular case where the gas is air (k=1.4), T1=kTa and Ta is equal to the suction gas temperature (Ta=Ts), Equation (2) becomes $$T_1 = \frac{T_1}{k}\left(\frac{P_1}{Ps}\right)^{\frac{k-1}{k}} \quad (5)$$

Since k=1.4, P1/Ps=3.25.

Figure 2:
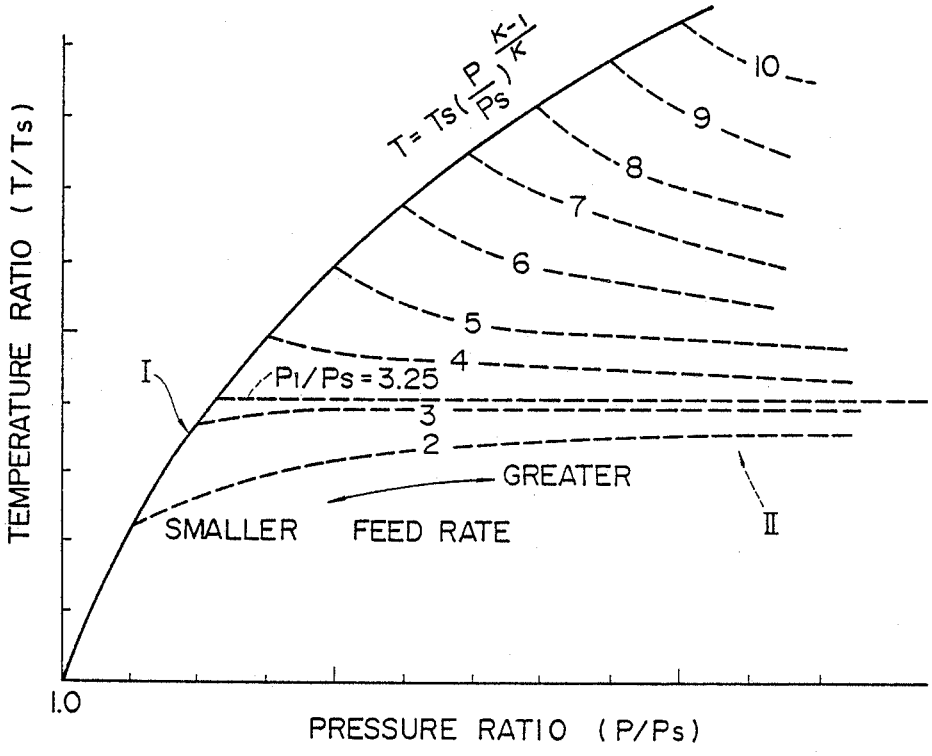
FIG. 2 is a graph showing the conditions of the compression stage before and after feeding air thereto.

Accordingly, as shown in FIG. 2 (abscissa=pressure ratio P/Ps; ordinate=temperature ratio T/Ts), the pressure and temperature are in the same relationship as Equation (2) in adiabatic compression of the suction gas alone, varying as indicated by curve I. In contrast, the group of broken line curves II indicates the conditions of air into which air of a temperature Ta, namely, of a temperature Ts in this instance is mixed at various points on the curve I under a pressure at the mixing point. In this diagram, the temperature T and pressure P at the initial points of the curves of group II on the curve I correspond to the temperature T1 and pressure P1 in Equation (3), and, as the amount of mixing air is increased, the conditions after mixing are shifted to more rightward points on the broken line curves of FIG. 2.

As explained by way of air in the foregoing example, the condition T1>kTa can be expressed by a pressure condition in a case where the temperature Ta of the feed air is controlled, for example, to Ta=Ts. Although it is expressed as a position which satisfies the pressure ratio P1/Ps≧3.25 in the foregoing example, it is to be noted that the paramount condition is T1≧kTa.

In consideration of the actual demands for gases of higher pressures in spite of increases in power consumption and in view of the difference in nature between the power consumption and gas pressure, it might be difficult to evaluate compressors simply by comparing figures in these aspects. However, in case of operations using air according to the method of present the invention, results of calculations showed the following changes in the discharge air temperature and power consumption.

| Discharge pressure(ata) | Discharge gas temp. ratio(%) | Power consumption ratio(%) |
|---|---|---|
| 8 | 80 | 101 |
| | 70 | 103 |
| | 65 | 105 |
| 11 | 75.7 | 101 |
| | 66 | 103 |
| | 60.7 | 105 |

These calculations adopted the above-described conditions for air, and the air feed position was assumed to be in a rotor chamber portion where no compression by the rotor occurs after feeding and which is immediately upstream of the discharge part. The terms "discharge gas temperature ratio" and "power consumption ratio" in the foregoing table mean the ratios of the discharge gas temperature and power consumption under air returning condition to the corresponding figures in operations without air returning.

It is clear from the results of calculations that, by recycling the high-pressure low-temperature air, the temperature increase can be suppressed to a marked degree with only a small increase in power consumption.

As will be understood from the foregoing description, the air feed position is desired to be as close to the discharge port as possible, namely, in the vicinity of the discharge port. However, in a case where a slight increase in power consumption is allowed due to the compressor construction, it may be shifted toward the suction port to a suitable degree as long as the condition Ta≦T1/k is satisfied.

Further, although theoretically the temperature Ta can be set at any low level, it will be almost equal to the temperature Ts of the suction air in practical applications where it is likely to use air from its own after-cooler as feed air, and therefore a practical level of the feed pressure of FIG. 2 is 3.25 or higher.

The method of the present invention has been described by way of an oil-free screw compressor in the foregoing embodiment, but it is to be understood that the invention also includes applications to oil-free displacement compressors.

Besides, the feed gas is not limited to air, or to the manner of feeding employed in the above-described embodiment. The gas may be fed back by branching off part of the discharge gas or from a separate high pressure gas source if desired.

As is clear from the foregoing description, in accordance with the method of the invention, a gas of a temperature Ta satisfying the following condition is fed to a space undergoing compression or to a discharge space in the vicinity of the discharge port:

$$Ta \leqq T1/k$$

wherein Ta is the temperature (°K.) of the feed gas; T1 is the temperature (°K.) of the compressed gas before feeding; and k is the polytropic index number.

Consequently, it becomes possible to increase the discharge gas pressure without entailing increases in temperature, permitting obtaining a discharge gas of high pressure by moderating the restrictions of the thermal expansion for realization of the so-called air-cooled type oil-free compressor.

Before proceeding with the description of an oil-free screw compressor which is suitable for carrying out the abovedescribed method of the invention, the increase in power consumption of the fore-mentioned prior art compressor is explained more particularly hereinafter to assist in the understanding of the compressor construction according to the present invention.

Given below is an example of calculations for a single stage oil-free screw compressor with an internal pressure ratio $\pi i = 5.0$.

The theoretical gas temperature Td' (°K.) and the discharge temperature Td (°K.) immediately upstream of the discharge port opening of the screw compressor and its power consumption Nth (kw) are expressed by the following equations.

$$Td' = Ts \cdot (1/vi)^{1-n}$$

$$Td = Ts \cdot (Pd/Ps)^{(n-1)/n}$$

$$Nth = \left(\frac{1 - vi^{n-1}}{1 - n} Ps - Ps + Pd \cdot \frac{1}{vi}\right) \cdot Vth \frac{10^4}{6120 \times 60}$$

where vi is the design volume ratio ($=\pi i^{1/n}$)

Ts is the suction temperature (°K.);

Ps is the suction pressure (kg/cm²A);

Pd is the discharge pressure (kg/cm²A);

Vth is the stroke volume (m³/hr); and n is the polytropic index number (=1.4).

Considering next then the case with general values, namely the case with Vth=500 m³/hr, Pd=8.033 kg/cm²A, Ps=1.033 kg/cm²A, Vi=3.17 and Ts=313° K., Td'=496.6° K., Td=562.4° K., and Nth=41.1 kw.

Figure 6:
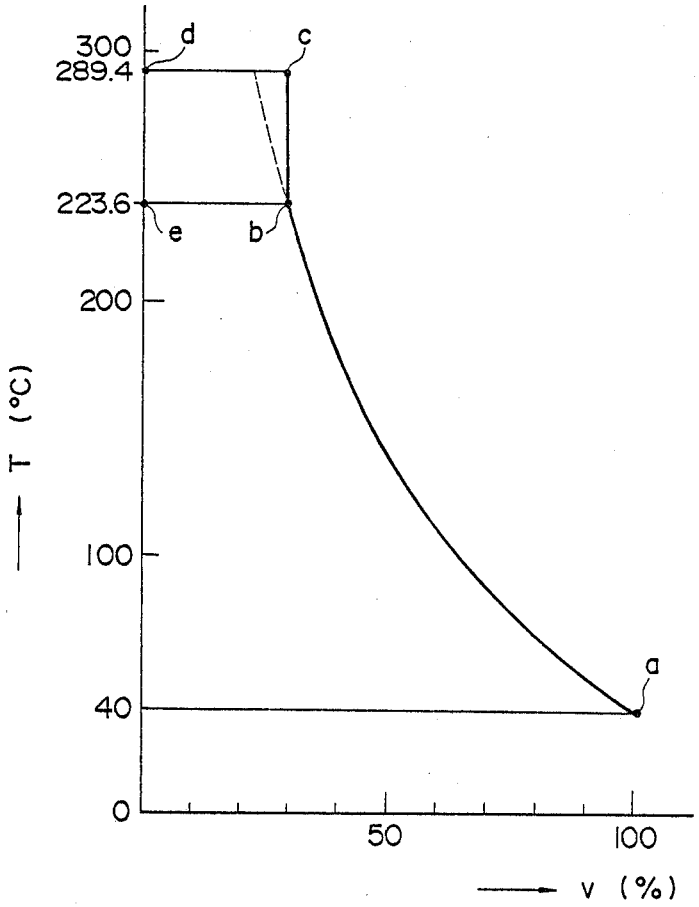
FIGS. 6 and 7 are T-V and P-V diagrams of the screw compressor.
Figure 7:
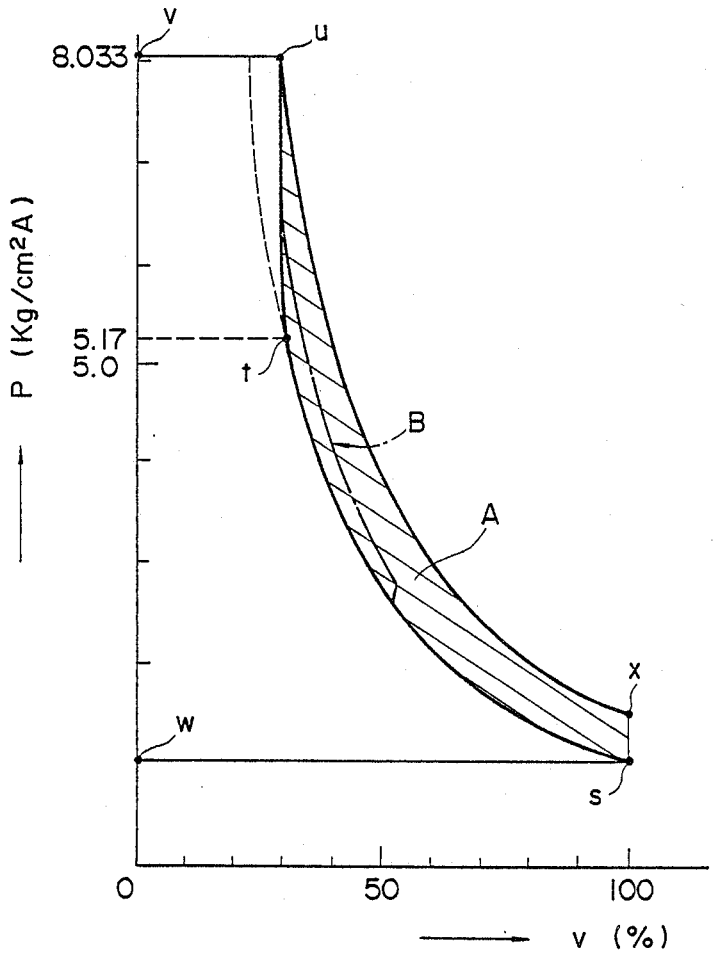

The foregoing values are for a case where part of the discharge gas is not returned to the suction side, and which is indicated by a curve through points a, b, c and d in the T-V diagram of FIG. 6 (abscissa=gas volume ratio V (the volume of the suction gas in compression/the volume of the suction gas before compression ×100; ordinate=gas temperature Ta), and by a curve through points s, t, u, v and w in the P-V diagram of FIG. 7 (abscissa=gas volume ratio V; ordinate=gas pressure P).

Next, to consider is a case where part of the discharge gas is returned to a space in the rotor chamber in a phase immediately after completion of suctioning such that the pressure Pd' immediately before the port opening becomes 8.033 kg/cm²A.

In this case, the pressure Ps' at the time of completion of suctioning is $$Ps' = Pd \cdot vi^{-n} = 1.60 \text{ kg/cm}^2\text{A}$$

and, if the return gas is sufficiently cooled and the temperature Ts' in the suction zone which has received the return gas is equal to Ts, $$Td' = 496.6° \text{ K. } (223.6° \text{ C.})$$

The power NthI is expressed as $$NthI = \left(\frac{1 - vi^{n-1}}{1 - n} Ps' - Ps + Pd \frac{1}{vi}\right) \cdot Vth \frac{10}{6120\ 60} (kw)$$

Therefore, $$NthI = 52.4 \text{ kw}$$

In this case, the changes of the gas condition are expressed by the curve through points a, b and e in the T-V diagram of FIG. 6 and the curve through points s, x, u and v in the P-V diagram of FIG. 7.

Namely, the discharge temperature is dropped by 66° C. while the power is increased by 11.13 kw (the hatched area A in the diagram indicates the increment). This increment in the power amounts to as much as 27% of the power consumption in a non-gas returning operation.

In order to hold Ts'=Ts, the temperature (K.) of the sufficiently cooled return gas should be theoretically cooled to a level of Ta=(1/n)Ts which is, however, as a practical matter difficult (because for example Ta=223.6° K.=−49° C. when Ts=313° K. and N=1.4).

Further, the return of the discharge gas to a phase immediately after completion of suctioning increases the pressure in a just-closed volute space of the rotor which is partitioned from the suction port by one rotor tooth, increasing gas leaks toward the suction port and thus inviting a drop in volume efficiency of the compressor.

The oil-free screw compressor construction of the invention can solve the above-mentioned problems of the prior art. Namely, the compressor construction of the invention permits lowering of the discharge temperature without entailing a material increasing in power consumption and to increase the discharge pressure without a drop in volume efficiency.

In accordance with the present invention, the oil-free screw compressor is provided with a bypass passage branched off on the exit side of a discharge gas cooling means in the discharge passage of the compressor and joined to a space of the rotor chamber located in the vicinity of the discharge port and closer to the discharge port than a rotor chamber wall portion communicable with the discharge port through a volute space at the screw rotors, or to a terminal discharge zone immediately downstream of a discharge initiating point.

The compressor construction according to the invention is described more particularly hereinafter by way of an embodiment shown in the drawings.

Figure 3:
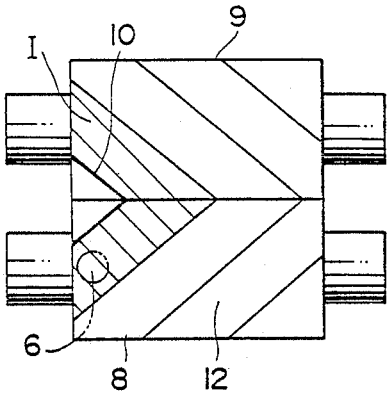
FIG. 3 is a plan view of rotors and a discharge port in the main compressor casing of FIG. 1.

In FIGS. 1 and 3, designated at 2 is the main compressor body (hereinafter referred to as the "casing") of the oil-free screw compressor according to the invention in which a gas suctioned through an inlet 7 is wrapped and compressed a volute space of a pair of intermeshed female and male rotors 8 and 9 and discharged into a discharge passage or port 3 through a discharge port 10 and discharge terminal 11. The discharge passage 3 is provided with an after-cooler 4 as a means for cooling the discharge gas, and a bypass passage 6 is branched off the discharge passage 3 on the downstream side of the after-cooler 4. This bypass passage 6 is connected to the casing 2 to join a wrapped volume space of a pair of intermeshed female and male rotors 8 and 9 at a position closest to the discharge port 10 or to the outlet portion of the discharge port.

The position which is communicable with the discharge port 10 through a volute space 12 comprises a position which is closer to the discharge port 10 than the right-hand seal line of a volute space the left-hand seal line of which has just reached the discharge port as indicated by hatching I in FIG. 3. Ignoring gap spaces between the rotors and between the rotors and casing, there is no possibility of communication with the discharge port 10 at a position which is closer to the suction port than that seal line.

As a result, part of the cooled discharge gas is returned to the rotor chamber in the vicinity of the discharge port by utilizing the pressure differential between the opposite ends of the bypass passage or inertial force due to flow of the gas as described below.

The pressure at the end of the bypass passage 6 on the side of the casing 2, namely, the pressure at the joining point is increased almost to a discharging pressure level until the volute space 12 is opened to the discharge port 10, reaching the discharging pressure level at the moment the volute space 12 is opened to the discharge port, and thereafter repeating these two conditions before and after opening to the discharge port 10.

On the other hand, the pressure on the exit side of the after-cooler 4 is at a lower level than the discharge pressure due to pressure losses in the discharge passage 3 and after-cooler 4.

Accordingly, the pressure at the joining end of the bypass passage 6 repeats fluctuations across the pressure level on the side of the discharge passage 3. Therefore, if the gas flow were determined solely by the pressure differential, the discharge gas would be returned through the bypass passage 6 only in a period immediately before discharge, when the pressure on the side of the casing 2 becomes lower, and would flow back to the discharge passage 3 through the bypass passage 6.

However, according to the results of experiments conducted by the inventors, due to the inertia of the gas flow which occurs in the bypass passage 6 toward the rotor chamber in the casing 2 in a period when the pressure of the bypass passage becomes lower on the side of the casing 2 immediately before a discharge, the gas flow tends to maintain its flow direction toward the rotor chamber for some time even when the pressure on the side of the casing 2 becomes higher than that of the discharge passage 3.

The compressor of the invention utilizes this phenomenon, returning part of the cooled discharge gas to a point in the vicinity of the discharge port 10, thereby cooling only a high pressure zone which needs cooling. Since the discharge gas is returned to a point immediately before discharge, the discharge pressure can be increased almost without increasing the power consumption of the compressor for compressing the return gas.

Accordingly, the joining point of the bypass passage 6 is determined in consideration of the power consumption and the discharge gas temperature of the compressor. Namely, with respect to the power consumption of the compressor, the joining point should be desirably as close to the discharge port 10 as possible. However, as the joining point approaches the discharge port 10, the discharge gas is returned to a higher pressure zone in the rotor chamber. This means that the discharge gas is returned to a zone of a higher temperature resulting from compression. In such a case, the compressed gas is cooled by the return gas, but the discharge gas temperature becomes higher as compared with a case where the joining point is remote from the discharge port 10.

Therefore, the joining point is preferred to be as close to the discharge port 10 as possible within a range not exceeding the upper limit of discharge temperature which is determined depending upon the purpose of use.

Theoretically, in a case where a gas having a temperature Ta and a weight Ga is fed to a gas of volume V, pressure P1, temperature T1 and weight G1 to obtain a discharge gas of pressure Pd, temperature Td and weight Gd without changing the volume V, $$Td = n \cdot Ta / \left\{ 1 + \left( n \cdot \frac{P_1}{T_1} - 1 \right) \cdot \frac{P_1}{Pd} \right\}$$

$$\frac{Ga}{G_1} = \frac{Pd/Td}{P_1/T_1} - 1$$

According to this theoretical formula, when a discharge gas of 55° C. is bypassed at a rate of 50% (wt% based on the suction gas) to a position where the internal pressure ratio is $\pi i = 5.0$, the discharge temperature is dropped by 80.4° C. and yet the power consumption is not increased as the gas is bypassed to a zone immediately before the discharge terminal.

Given below are results of further experiments, in which the bypass passage was joined to a compressor with an internal pressure ratio $\pi i = 5$ at a position corresponding to a pressure ratio 3.8 to return part of the discharge air from an after-cooler.

The following data were sampled in both open and closed conditions of the bypass passage, rotating the rotors at a speed N=21,200 rpm and passing water of a temperature Tw=32° C.

| Bypass Passage | Closed | Open |
|---|---|---|
| Discharge Pressure Pd (kg/cm$^2$G) | 7.0 | 7.0 |
| Suction Temperature (°C.) | 40 | 40 |
| Discharge Temperature Td (°C.) | 332 | 297 |
| Power (kw) | 55.0 | 55.9 |
| Discharge Air Quantity Q (m$^3$/min) | 6.7 | 6.7 |
| Calculated | 0 | 1.41 (21% of Q) |

-continued

| Bypass Passage | Closed | Open |
|---|---|---|
| Bypass Rate | | |

According to the results of these experiments, the power N is increased by 1.6% with the bypass passage in closed state as compared with the open state of the bypass passage, but the discharge temperature is lowered by 35° C. (a drop of about 10% of the gas temperature increase in the closed state). Namely, the discharge temperature Td was lowered substantially without a material increase in power N.

In FIG. 7, the curve of the single-dot chain line indicates variations in the gas condition in the compressor according to the invention, indicating that the bypassing incurred only a small increase in power consumption.

Figure 4:
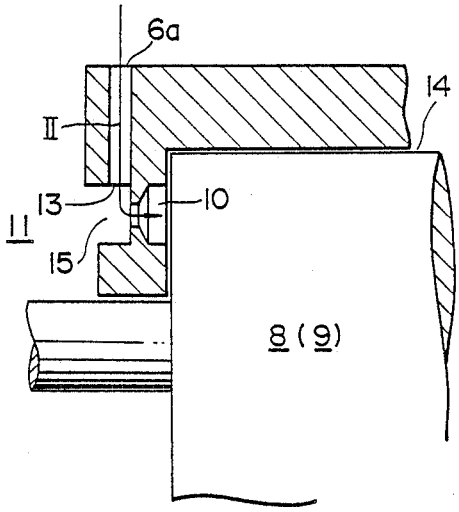
FIGS. 4 and 5 are fragmentary sectional views through the junction of a bypass passage according to the present invention.
Figure 5:
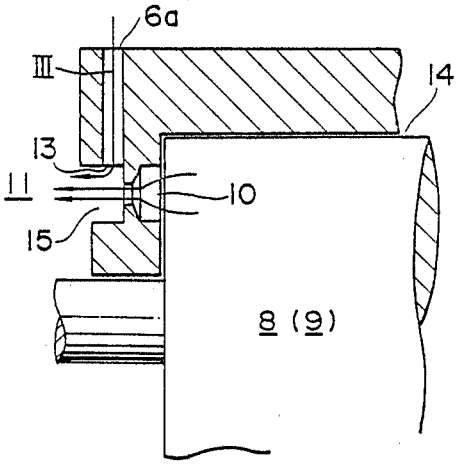

Although the bypass passage 6 is joined to a volute space 12 immediately upstream of the discharge terminal 11 in the foregoing embodiment, the present invention is not limited to such an arrangement and includes a compressor with a bypass passage *6a* having its joining end 13 located closer to the discharge terminal 11 than the discharge port 10 as shown in FIGS. 4 and 5.

In this compressor, the discharge port 10 is constricted to have a smaller open sectional area on the side of the discharge terminal 11 than on the side of the rotor chamber 14, forming an ejector 15 together with the joining end portion 13. When the pressure in the rotor chamber 14 is lower than in the joining end 13, the gas in the bypass passage *6a* flows into the rotor chamber 14 as shown in FIG. 4 (see arrow II). On the contrary, when the pressure in the rotor chamber 14 becomes higher to discharge the gas therefrom, the velocity of the gas flow in the discharge port 10 is increased in the constricted portion on the side of the discharge terminal 11, as a result lowering the gas pressure at the joining end 13 and urging gas flows from the bypass passage *6a* to the terminal discharge opening 11 (see arrow III) to prevent retrogressive gas flows into the bypass passage *6a*.

With this compressor, the gas from the bypass passage *6a* is not compressed by the screw rotors 8 and 9, so that the vicinity of the discharge port 10 can be thereby cooled without entailing an increase in power consumption.

As is clear from the foregoing description, according to the present invention, a bypass passage which is branched off on the exit side of a discharge gas cooling means in a discharge gas pressure is joined to a space in the rotor chamber in the vicinity of the discharge port at a position closer to the discharge port than a rotor chamber wall portion communicable with the discharge port through a volute space of the screw rotors, or to a terminal discharge portion immediately downstream of a discharge initiating point.

Therefore, the invention has the effects of lowering the discharge temperature efficiently and raising the discharge pressure, without causing deteriorations in volume efficiency and increases in power consumption.

What is claimed is:

1. A method for operating an oil-free screw compressor, which comprises:

feeding a gas of a temperature Ta to a discharge space in the vicinity of a discharge port of said compressor, the temperature Ta satisfying the relationship:

$$Ta \leqq T1/k$$

wherein Ta is the temperature (°K.) of said feed gas; T1 is the temperature (°K.) of the compressed gas before feeding; and k is a polytropic index number.

* * * * *